US010417966B2

(12) United States Patent
Xu

(10) Patent No.: US 10,417,966 B2
(45) Date of Patent: Sep. 17, 2019

(54) BRIGHTNESS REGULATION METHOD OF A DISPLAY PANEL AND BRIGHTNESS REGULATION DEVICE

(71) Applicant: Shenzhen China Star Optoelectronics Semiconductor Display Technology Co., Ltd., Shenzhen, Guangdong (CN)

(72) Inventor: Jing Xu, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 21 days.

(21) Appl. No.: 15/764,360

(22) PCT Filed: Dec. 13, 2017

(86) PCT No.: PCT/CN2017/115991

§ 371 (c)(1),
(2) Date: Mar. 29, 2018

(87) PCT Pub. No.: WO2019/061849

PCT Pub. Date: Apr. 4, 2019

(65) Prior Publication Data

US 2019/0103056 A1 Apr. 4, 2019

(51) Int. Cl.
*G09G 3/3258* (2016.01)
*G09G 3/3208* (2016.01)

(52) U.S. Cl.
CPC ..... *G09G 3/3258* (2013.01); *G09G 3/3208* (2013.01); *G09G 2320/0626* (2013.01); *G09G 2340/16* (2013.01); *G09G 2360/16* (2013.01)

(58) Field of Classification Search
CPC ..... G09G 3/3258; G09G 3/3208; G09G 2360/16; G09G 2340/16; G09G 2320/0626
See application file for complete search history.

(56) References Cited

U.S. PATENT DOCUMENTS

2006/0284805 A1* 12/2006 Baek ..... G09G 3/3607 345/88
2007/0025683 A1* 2/2007 Nobori ..... G09G 3/3611 385/147

(Continued)

FOREIGN PATENT DOCUMENTS

CN 1641731 A 7/2005
CN 101739939 A 6/2010

(Continued)

*Primary Examiner* — Premal R Patel
(74) *Attorney, Agent, or Firm* — Andrew C. Cheng

(57) ABSTRACT

A brightness regulation method and a brightness regulation device are disclosed. The method includes: obtaining an average image voltage value of each image in previous N images; calculating an average voltage value according to the average image voltage value of each image in previous N images; obtaining a brightness trend regulation coefficient and a brightness regulation coefficient according to the average voltage value; and performing a brightness regulation to a brightness of a (N+1)-th image to be displayed according to the brightness trend regulation coefficient and the brightness regulation coefficient. When an average value of the average image voltage values is smaller, and less than a threshold value, the (N+1)-th image to be displayed will continue a low brightness status so as to regulate and decrease the brightness of the (N+1)-th image in order to avoid a sudden change in current and brightness of the (N+1)-th image.

3 Claims, 4 Drawing Sheets

(56) References Cited

U.S. PATENT DOCUMENTS

| | | | | |
|---|---|---|---|---|
| 2007/0273776 | A1* | 11/2007 | Lee | H04N 5/202 348/254 |
| 2012/0306947 | A1* | 12/2012 | Kim | G09G 3/3233 345/694 |
| 2013/0076803 | A1 | 3/2013 | Lee | |

FOREIGN PATENT DOCUMENTS

| | | | |
|---|---|---|---|
| CN | 101777311 | A | 7/2010 |
| CN | 102123235 | A | 7/2011 |
| CN | 102810293 | A | 12/2012 |
| CN | 103024320 | A | 4/2013 |
| CN | 105047179 | A | 11/2015 |
| CN | 105528994 | A | 4/2016 |
| CN | 105657301 | A | 6/2016 |
| CN | 106157889 | A | 11/2016 |
| JP | 08317250 | A | 11/1996 |

* cited by examiner

BRIGHTNESS REGULATION METHOD OF A DISPLAY PANEL AND BRIGHTNESS REGULATION DEVICE

BACKGROUND OF THE INVENTION

1. Field of the Invention

The present invention relates to a display technology field, and more particularly to a brightness regulation method of a display panel and brightness regulation device.

2. Description of Related Art

A display panel such as OLED (Organic Light Emitting Diode) display panel is more and more important in the display field because of wider viewing angle, higher refresh rate and thinner thickness. However, an ageing problem of the OLED is a key factor that limits the development of the OLED display panel.

For the ageing problem, a common solution is to use an Average Picture Level (APL) method to calculate a brightness degree of an image. If the image is too bright, though regulating a data, gamma voltage or an OLED voltage to decrease the current and the brightness in order to reduce the power consumption of the OLED to delay the ageing of the OLED at the same time.

If using the method for regulating a data, a memory space of at least one frame for storing an image data is required so that a higher requirement of access speed of processor and hardware resource are required.

For the problem that requires external storage space to store the image data, a general method is: obtaining an average value of an APL value of previous N images, and applying the average value to a (N+1)-th image in order to save the memory space required by APL. However, the above method has a drawback. When a difference between the brightness before and after the current image is too large (for example, continuous dark images switched to a high brightness image suddenly), the regulation for the brightness of the high brightness image will use the average value obtained under the dark images. Accordingly, the brightness will not be regulated or the effect is small. Then, because the calculation of the average value of the APL value adds the APL value of the high brightness image, the average value of APL value used in a (N+2)-th image will increase, and the brightness will decrease. The above process will generate a sudden change in current and brightness, which is unfavorable for a circuit design or viewing effect.

SUMMARY OF THE INVENTION

In order to solve the problem existed in the current technology, the purpose of the present invention is to provide a brightness regulation method and a brightness regulation device, which can prevent a sudden change in the OLED current and the image brightness.

Accordingly to one aspect of the present invention, providing a brightness regulation method of a display panel, comprising: obtaining an average image voltage value of each image in previous N images; calculating an average voltage value according to the average image voltage value of each image in previous N images; obtaining a brightness trend regulation coefficient and a brightness regulation coefficient according to the average voltage value; and performing a brightness regulation to a brightness of a (N+1)-th image to be displayed according to the brightness trend regulation coefficient and the brightness regulation coefficient.

Wherein the step of obtaining a brightness trend regulation coefficient according to the average voltage value comprises: looking up a value corresponding to the average voltage value at a preset brightness trend regulation curve, and obtaining the brightness trend regulation coefficient according to the value.

Wherein the step of obtaining an average image voltage value of each image in previous N images comprises: obtaining a brightness of each pixel in each image in the N images; and obtaining the average image voltage value of each image according to the brightness of each pixel in each image in the N images.

Wherein the step of obtaining a brightness of each pixel in each image in the N images comprises: obtaining grayscale values of a R component, a G component and a B component of each image in the N images; transforming the grayscale values of the R component, the G component and the B component into a brightness under a YCbCr space, or using a maximum value of the R component, the G component and the B component as the brightness; the step of calculating the average image voltage value of each image in the N images comprises: performing a gamma transformation to the brightness of each pixel in each image in N images; and obtaining the average image voltage value of each image in N images according to the brightness after being performing the gamma transformation.

Wherein the step of obtaining a brightness regulation coefficient according to the average voltage value comprises: looking up a value corresponding to the average voltage value at a preset brightness regulation curve, and obtaining the brightness regulation coefficient according to the value.

According to another aspect of the present invention, also proving a brightness regulation device of a display panel, comprising: an average image voltage value obtaining module for obtaining an average image voltage value of each image in previous N images; an average voltage value calculating module for calculating an average voltage value according to the average image voltage value of each image in previous N images; a coefficient obtaining module for obtaining a brightness trend regulation coefficient and a brightness regulation coefficient according to the average voltage value; and a brightness regulation module for performing a brightness regulation to a brightness of a (N+1)-th image to be displayed according to the brightness trend regulation coefficient and the brightness regulation coefficient.

Wherein the coefficient obtaining module is further used for looking up a value corresponding to the average voltage value at a preset brightness trend regulation curve, and obtaining the brightness trend regulation coefficient according to the value.

Wherein the average image voltage value obtaining module comprises: a pixel brightness obtaining unit for obtaining a brightness of each pixel in each image in the N images; and an average image voltage value calculation unit for obtaining the average image voltage value of each image according to the brightness of each pixel in each image in the N images.

Wherein the pixel brightness obtaining unit comprises: a pixel grayscale obtaining sub-unit for obtaining grayscale values of a R component, a G component and a B component of each image in the N images; for transforming the grayscale values of the R component, the G component and the B component into a brightness under a YCbCr space, or using a maximum value of the R component, the G component and the B component as the brightness; the average image voltage calculation unit comprises: a transformation sub-unit for performing a gamma transformation to the brightness of each pixel in each image in N images; and an average image voltage calculation sub-unit for obtaining the average image voltage value of each image in N images according to the brightness after being performing the gamma transformation.

Wherein the brightness regulation coefficient obtaining module is further used for looking up a value corresponding to the average voltage value at a preset brightness regulation curve, and obtaining the brightness regulation coefficient according to the value.

The beneficial effect of the present invention: when an average value of the average image voltage values of the previous N images is smaller, and less than a threshold value, the (N+1)-th image to be displayed will continue a low brightness status so as to regulate and decrease the brightness of the (N+1)-th image in order to avoid a sudden change in current and brightness of the (N+1)-th image.

BRIEF DESCRIPTION OF THE DRAWINGS

Through following to combine figures to describe in detail, the above, the other purposes, the features and benefits of the exemplary embodiment of the present disclosure will become clearer, in the figures.

DETAILED DESCRIPTION OF THE PREFERRED EMBODIMENT

The following content combines with the drawings and the embodiment for describing the present invention in detail. However, many other forms can be used to implement the present invention. Besides, the present invention should not be interpreted to be limit in the specific embodiment described here. On the contrary, the embodiments provided here are used for explaining the operation principle and practical application such that person skilled in the art can under various embodiments of the present invention and various modification suitable for specific applications.

The present invention adopts an OLED display panel to illustrate the brightness regulation method of the display panel.

Figure 1:
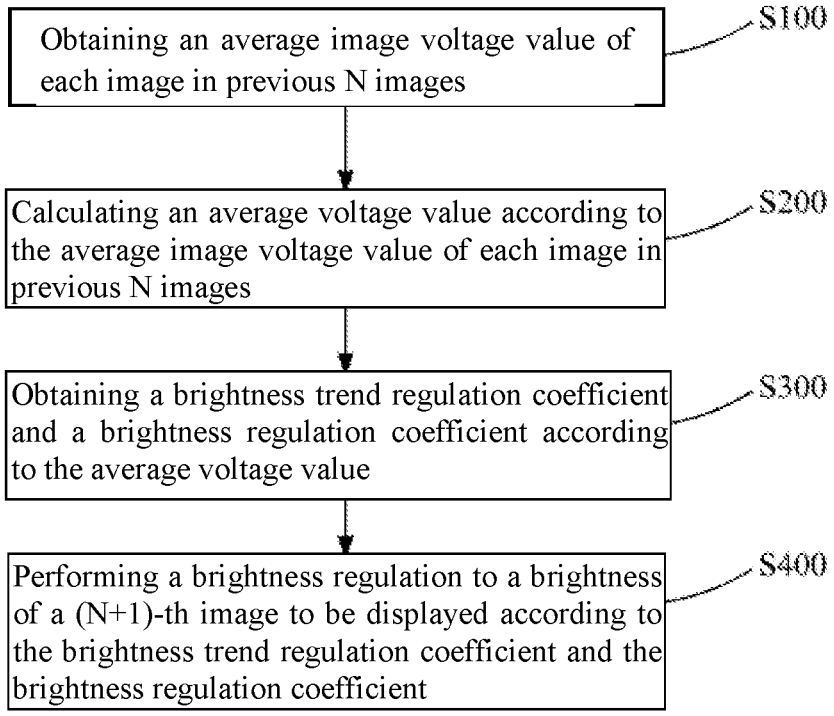
FIG. 1 is a flow chart of a brightness regulation method of a display panel according to an embodiment of the present invention.

FIG. 1 is a flow chart of a brightness regulation method of a display panel according to an embodiment of the present invention.

With reference to FIG. 1, the brightness regulation method of a display panel according to an embodiment of the present invention comprises step S100 to step S400.

Figure 2:
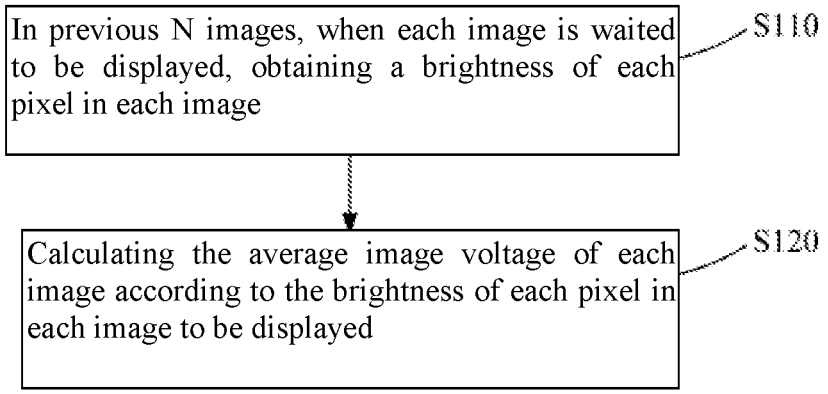
FIG. 2 is a flow chart of a specific method for realizing the step S100 shown in FIG. 1.

Specifically, in the step S100, obtaining an average image voltage value of each image in previous N images. FIG. 2 is a flow chart of a specific method for realizing the step S100 shown in FIG. 1.

With reference to FIG. 2, the specific method for realizing the step S100 shown in FIG. 1 includes a step S110 and a step S120.

In the step S110, in previous N images, when each image is waited to be displayed, obtaining a brightness of each pixel in each image.

Specifically, the display image viewed by human eyes in a display panel is formed by pixels. Each pixel is formed by three sub-pixels of a red sub-pixel, a green sub-pixel and a blue sub-pixel. Each sub-pixel can show different brightness levels. Grayscale levels represent the different brightness levels from the darkest to the brightest. When middle levels are more, the display effect shown is more delicate.

Using an 8-bits display panel as an example, in order to reach 2 to the power of 8, that is, 256 brightness levels, or 0-255 grayscale levels. Each pixel at the display image is formed by a combination of the red sub-pixel, the green sub-pixel and the blue sub-pixel having different grayscale levels, and finally, color dots having different brightness are formed. That is, a change of the brightness and the color at each dot on the display panel is actually formed by the change of the grayscale levels of the three RGB sub-pixels that constitutes the dot.

Therefore, the brightness of each pixel of an image to be displayed can be obtained by calculating the grayscale levels of the R, G, and B components of an image to be displayed. The specific calculation method can select: transforming the grayscale levels of the R, G, B components in a brightness Y in a YCbCr space, wherein $Y=0.299R+0.587G+0.114B$. Or, using a maximum value of the grayscale levels of the R, G, B components as the brightness $Y:Y=Max(R, G, B)$. In another embodiment, the other calculation method can be selected, the present invention is not limited.

After executing the step S110, further executing a step S120. In the step S120, calculating the average image voltage of each image according to the brightness of each pixel in each image to be displayed.

The method for realizing the step S120 specifically includes:

Firstly, performing a gamma transformation to the brightness of each pixel of each image to be displayed;

In the step of performing a gamma transformation to the brightness of each pixel of each image to be displayed, the calculation method can select: $Y'=(Y/255)^{GMA}\times 255$.

Wherein, Y' represents the brightness after being performed, GMA represent a gamma value of the display panel. The purpose of performing the gamma transformation to the brightness is to make the following target value can meet the gamma property of the display panel in order to render an actually brightness degree of the pixels. The value 255 in the calculation formula Y' represents a greatest grayscale level of the display panel and depends on the number of the bits of the display panel. Here, the value 255 is a greatest grayscale level of an 8-bit display panel. In another embodiment, a greatest grayscale level of a 10-bit display panel is 1023, and the value corresponding to formula is 1023.

Then, calculating the average image voltage (APL) value of each image to be displayed according to the brightness after performing the gamma transformation.

The average image voltage value of each image to be displayed is an average brightness value of each pixel after performing the gamma transformation, the calculating method can select:

$$APL_A=\Sigma_{i=1,j=1}^{i=m,j=n}Y'_{ij}/(m\times n)$$

Wherein, $APL_A$ represents an average image voltage of an A-th image to be displayed, 1<A<N. The "m" represents the number of rows, and the "n" represents the number of columns, and the term "m×n" represents the number of all pixels of an image to be displayed. The range of the $APL_A$ is related to the bit number of the display panel. For example, if the display panel is 8-bit, a brightness level of 2 to the power of 8 can be performed, and the range of $APL_A$ is in a range of 0-255; if the display panel is 10-bit, a brightness level of 2 to the power of 10 can be performed, and the range of $APL_A$ is in a range of 0-1023.

In order to realize conveniently, sometime, a normalization to the $APL_A$ is performed. A following calculation is performed based on the above description: $APL_A$ $APL_A$/255×100.

Wherein, the value 255 is the greatest grayscale level of an 8-bit display panel. For a 10-bit display panel, the denominator is 1023. The formula is modified adaptively according to an actual situation. After the normalization, the $APL_A$ is within a range of 0-100.

After executing the step S100, the step S200 is further executed. In the step S200, calculating an average voltage value according to the average image voltage value of each image in previous N images.

The average voltage value is an average value of the average image voltage values of previous N images, the calculation method can be:

$$AVG=\sum_{A=1}^{N}APL_A/N$$

Wherein, AVG represents the average value of the average image voltage values of previous N image.

After executing the step S200, further performing the step S300. In the step S300, obtaining a brightness trend regulation coefficient and a brightness regulation coefficient according to the average voltage value.

Specifically, looking up a value corresponding to the average voltage value at a preset brightness trend regulation curve, and obtaining the brightness trend regulation coefficient according to the value.

The brightness trend regulation curve can be a relationship curve between the average voltage value and the brightness trend regulation coefficient. Directly obtaining the brightness regulation coefficient according to the curve.

Figure 3:
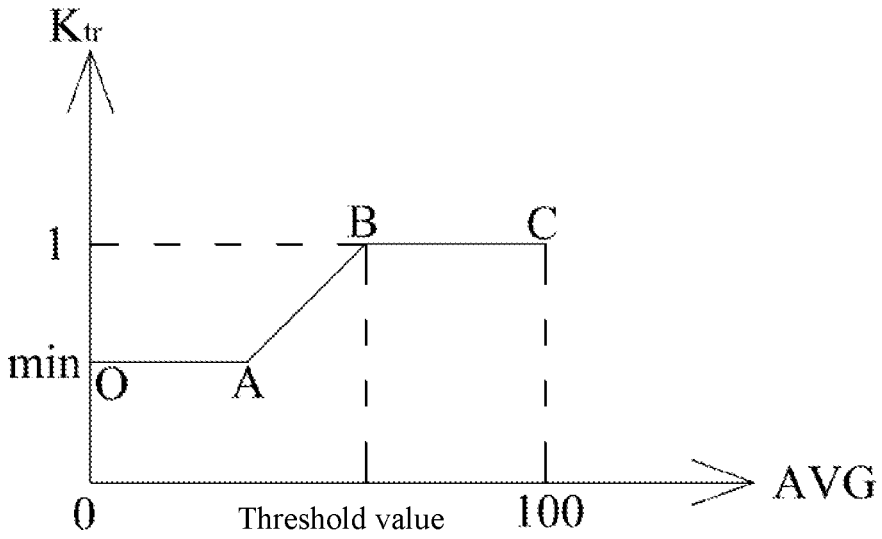
FIG. 3 is a schematic diagram of a brightness trend regulation curve according to an embodiment of the present invention.

As shown in FIG. 3, the brightness trend regulation curve is a relationship curve between the average voltage value and the brightness trend regulation coefficient. The brightness trend regulation curve in FIG. 3 is for an 8-bit display panel.

In FIG. 3, the horizontal axis represents AVG, the value is in a range of 0-100. The vertical axis represents the brightness trend regulation coefficient $K_{tr}$, and the maximum value is 1, the minimum value is min, and min is a value greater than 0 and less than 1 The relationship curve in the figure can divided into three sections. From point O to point A, a horizontal straight line is presented. From point A to point B, an oblique line is existed. From point B to point C, a horizontal straight line is presented. Wherein, the oblique line from point A to point B can be divided into an oblique line having multiple sections and different intervals, and slopes can be different.

If the value of the AVG is smaller after being calculated, that is, an average value of the average image voltage values of the previous N images is smaller, within a value range from point O to point A, the corresponding brightness trend regulation coefficient is min. If the value of the AVG after being calculated is in a value range from point A to point B, the corresponding brightness trend regulation coefficient is an arbitrary value that is greater than min and less than 1 If the value of the AVG after being calculated is in a value range from point B to point C, the corresponding brightness trend regulation coefficient is 1.

Figure 4:
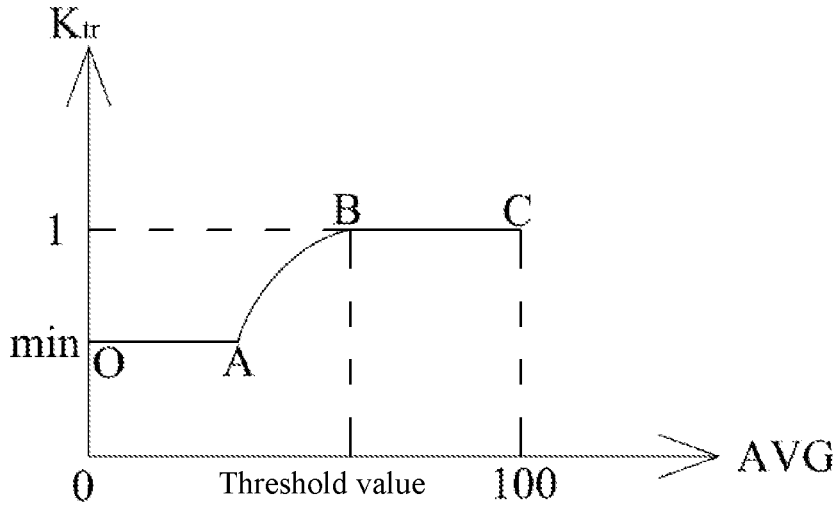
FIG. 4 is a schematic diagram of a brightness trend regulation curve according to another embodiment of the present invention.

In another embodiment, as shown in FIG. 4, the point A to point B can also be a curve protruded upward, but the present invention is not limited. For example, the point A to point B can also be a curve protruded downward.

Besides, specifically, looking up a value corresponding to the average voltage value at a preset brightness regulation curve, and obtains a brightness regulation coefficient according to the value.

The brightness regulation curve can be a relationship curve of the average voltage value and a brightness of a pixel in a (N+1)-th image to be displayed after regulation. Calculating a ratio of the brightness of the pixel after being regulated and before being regulated to obtain the brightness regulation coefficient. The brightness regulation curve can also be a relationship curve of the average voltage value and the brightness regulation coefficient, and directly obtaining the brightness regulation coefficient according to the curve. Therefore, looking up a value corresponding to the brightness regulation curve. The value is not limited, and can be decided by an actually requirement.

Figure 5:
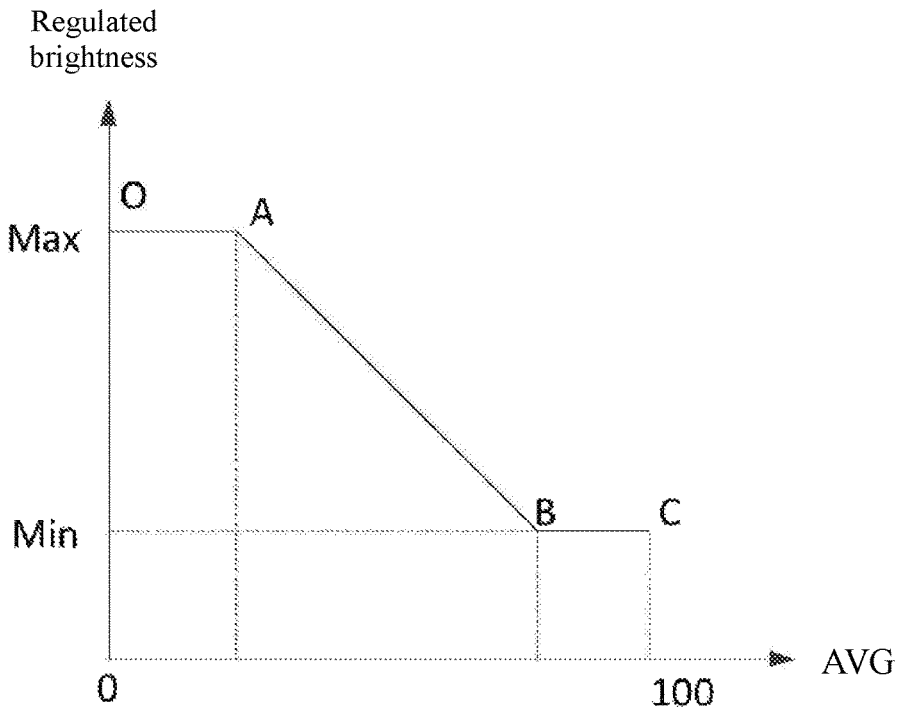
FIG. 5 is a schematic diagram of a brightness regulation curve according to an embodiment of the present invention.

As shown in FIG. 5, the brightness regulation curve is a relationship curve of the average voltage value and the brightness of a pixel in (N+1)-th image to be displayed. Generally, the pixel in the image to be displayed usually selects the pixel having the greatest grayscale level in order to simplify the relationship of the function for operating conveniently.

The brightness regulation curve in FIG. 5 is for the 8-bit display panel, and selecting the pixel having the greatest grayscale level of 255. From the above calculation method, the brightness of the pixel having the greatest grayscale level of 255 before being regulated is 255.

In FIG. 5, the horizontal axis represents the average voltage value AVG of the (N+1)-th image to be displayed. A value range is 0-100. The vertical axis represents the required brightness after being regulated, and the maximum value MAX is 255. The relationship curve in the figure can divided into three sections. From point O to point A, a horizontal straight line is presented. From point A to point B, an oblique line is existed. From point B to point C, a horizontal straight line is presented. Wherein, the oblique line from point A to point B can be divided into an oblique line having multiple sections and different intervals, and slopes can be different.

If the value of the AVG is smaller after being calculated, that is, an average brightness of an image to be displayed is very low, within a value range from point O to point A, the corresponding brightness after being regulated is 255, the brightness regulation coefficient is 1 (it should be noted that disposing the brightness after being regulated to be 255 is only one embodiment, other values can also be disposed according to an actual requirement, and the corresponding brightness regulation coefficient can also be another value, not 1). The brightness of an image to be displayed before and after being regulated is unchanged. If the value of the AVG is within a value range from point A to point B, the brightness after being regulated is less than the brightness maximum value 255, and the brightness regulation coefficient is less than 1 so that the brightness of the image to be displayed is required to be decreased. If the value of the AVG is closed to 100, the average brightness to be displayed is very bright, and the power consumption is too high. The corresponding brightness after being regulated is limited to be within a minimum brightness. At this time, a large regulation is required in order to decrease the brightness of the image to be displayed.

Figure 6:
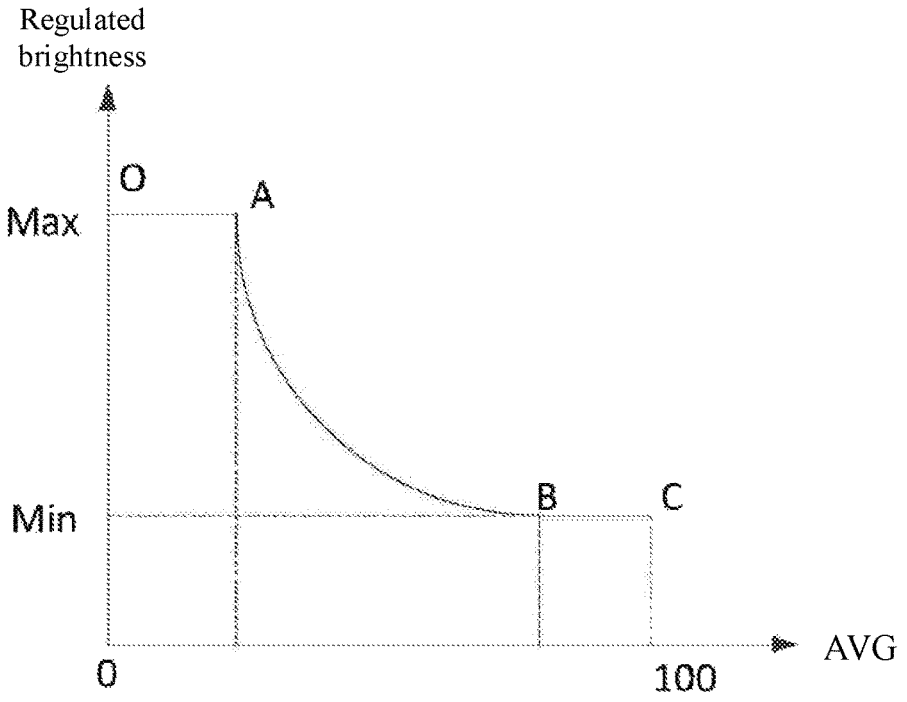
FIG. 6 is a schematic diagram of a brightness regulation curve according to another embodiment of the present invention.

In another embodiment, as shown in FIG. 6, the brightness regulation curve is also a relationship curve of an average voltage and a pixel in an image to be displayed. However, different from FIG. 5, the curve from point A to point B is arc-shaped. Different AVG correspond to different slopes. The brightness regulation curve is not limited to the two types, and should be decided by an actual requirement.

After executing the step S300, the step S400 is further executed. In the step S400, performing a brightness regulation to a brightness of a (N+1)-th image to be displayed according to the brightness trend regulation coefficient and the brightness regulation coefficient.

Specifically, adopting a following calculation method to perform a brightness regulation to a brightness of a (N+1)-th image to be displayed according to the brightness trend regulation coefficient and the brightness regulation coefficient:

$$Lum' = Lum * K_{APL} * K_{tr}$$

Wherein, Lum' is the brightness of the (N+1)-th image to be displayed after being regulated in the brightness. Lum is the brightness of the (N+1)-th image to be displayed before being regulated in the brightness, $K_{APL}$ represents a brightness regulation coefficient, $K_{tr}$ represents a brightness trend regulation coefficient.

Here, when an average value of the average image voltage values of previous N image is smaller, within a range from point O to point B (that is, the average value AVG of the average image voltage values is less than the threshold value shown in FIG. 3 and FIG. 4), the (N+1)-th image to be displayed will continue a low brightness status so as to regulate and decrease the brightness of the (N+1)-th image in order to avoid a sudden change in current and brightness of the (N+1)-th image.

Through above steps, when the average value of the average image voltage value of the continuous N images, the (N+1)-th image to be displayed will continue a low brightness status is realized. It should be noted that, the present embodiment adopts an OLED display panel as an example, but not means that the brightness regulation method of the present invention only suitable for an OLED display panel. In another embodiment such as a liquid crystal display device, when the requirement for continuing the brightness status of previous N images is also existed, the brightness regulation method of the display panel of the present invention is still suitable.

Figure 7:
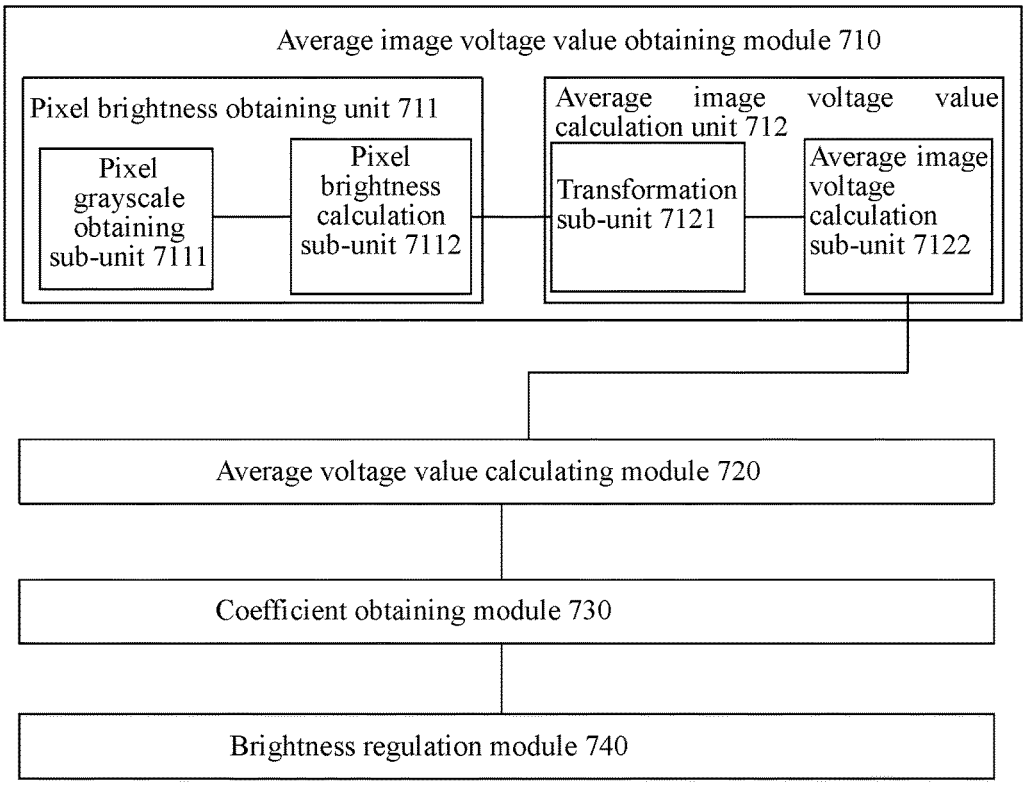
FIG. 7 is an operation diagram of a brightness regulation device of a display panel according to an embodiment of the present invention.

The following will illustrate the brightness regulation device of the display panel according to the embodiment of the present invention. FIG. 7 is an operation diagram of a brightness regulation device of a display panel according to an embodiment of the present invention.

With reference to FIG. 7, the brightness regulation device of the display panel according to the embodiment of the present invention includes an average image voltage value obtaining module 710, an average voltage value calculating module 720, a coefficient obtaining module 730 and a brightness regulation module 740.

The average image voltage value obtaining module 710 is configured for obtaining an average image voltage value of each image in previous N images.

The average voltage value calculating module 720 is configured for calculating an average voltage value according to the average image voltage value of each image in previous N images.

The coefficient obtaining module 730 is configured for obtaining a brightness trend regulation coefficient and a brightness regulation coefficient according to the average voltage value.

The brightness regulation module 740 is configured for performing a brightness regulation to a brightness of a (N+1)-th image to be displayed according to the brightness trend regulation coefficient and the brightness regulation coefficient.

Besides, the coefficient obtaining module 730 is further used for looking up a value corresponding to the average voltage value at a preset brightness trend regulation curve, and obtaining the brightness trend regulation coefficient according to the value.

Besides, the average image voltage value obtaining module 710 includes: a pixel brightness obtaining unit 711 and an average image voltage value calculation unit 712.

The pixel brightness obtaining unit is configured for obtaining a brightness of each pixel in each image in the N images. Specifically, the pixel brightness obtaining unit 711 includes: a pixel grayscale obtaining sub-unit 7111 and a pixel brightness calculation sub-unit 7112. The pixel grayscale obtaining sub-unit 711 is configured for obtaining grayscale values of an R component, a G component and a B component of each image in the N images. The pixel brightness calculation sub-unit 7112 is configured for transforming the grayscale values of the R component, the G component and the B component into a brightness under a YCbCr space, or using a maximum value of the R component, the G component and the B component as the brightness;

The average image voltage value calculation unit 712 is configured for obtaining the average image voltage value of each image according to the brightness of each pixel in each image in the N images. Specifically, the average image voltage calculation unit 712 includes: a transformation sub-unit 7121 and an average image voltage calculation sub-unit 7122. The transformation sub-unit 7121 is configured for performing a gamma transformation to the brightness of each pixel in each image in N images. The average image voltage calculation sub-unit 7122 is configured for obtaining the average image voltage value of each image in N images according to the brightness after being performing the gamma transformation.

The coefficient obtaining module 730 is further used for looking up a value corresponding to the average voltage value at a preset brightness regulation curve, and obtaining the brightness regulation coefficient according to the value Besides, the present invention is described according to the method and the equipment (or system) of the embodiment of the present invention. It can be understood that each process and/or block, a combination of process and/or block in the flow chart and/or the block diagram can the present invention can be realized by computer program instructions and information sensing device. The computer program instructions can be provided to a general computer, application specific computer, an embedded processor or the processor of other programmable data processing equipment to execute the program instructions and cooperate with the information sensing device to realize the device having the specific function in one process or multiple processes in the flow chart and/or one block or multiple blocks on the block diagram.

Besides, each device, element or module in the display device according to an embodiment of the present invention can be realized as a hardware component. The treatment executed by the person skilled in the art according to each device, component and module can utilize a Field Programmable Gate Array (FPGA) or a Specific Integrated Circuit (ASIC) to realize each module, unit or sub-unit.

The above embodiments of the present invention are only exemplary, however, the present invention is not limited. The person skilled in the art can understand: without exceeding the principle and spirit of the present invention, the above embodiments can be changed in form and detail.

What is claimed is:

1. A brightness regulation method of a display panel, comprising:

obtaining an average image voltage value of each image in previous N images, (wherein N>0);

calculating an average voltage value according to the average image voltage value of each image in previous N images;

obtaining a brightness trend regulation coefficient and a brightness regulation coefficient according to the average voltage value; and performing a brightness regulation to a brightness of a (N+1)-th image to be displayed according to the brightness trend regulation coefficient and the brightness regulation coefficient;

wherein, $Lum'=Lum*K_{APL}*K_{tr}$ wherein, Lum' is the brightness of the (N+1)-th image to be displayed after being regulated in the brightness, Lum is the brightness of the (N+1)-th image to be displayed before being regulated in the brightness, $K_{APL}$ represents the brightness regulation coefficient, $K_{tr}$ represents the brightness trend regulation coefficient;

wherein the step of obtaining an average image voltage value of each image in previous N images comprises:

obtaining a brightness of each pixel in each image in the N images; and obtaining the average image voltage value of each image according to the brightness of each pixel in each image in the N images;

wherein the step of obtaining a brightness of each pixel in each image in the N images comprises:

obtaining grayscale values of a R component, a G component and a B component of each image in the N images;

transforming the grayscale values of the R component, the G component and the B component into a brightness under a YCbCr space, or using a maximum value of the R component, the G component and the B component as the brightness;

the step of calculating the average voltage value of each image in the N images comprises: performing a gamma transformation to the brightness of each pixel in each image in N images; and obtaining the average image voltage value of each image in N images according to the brightness after being performing the gamma transformation.

2. The brightness regulation method of a display panel according to claim 1, wherein the step of obtaining a brightness trend regulation coefficient according to the average voltage value comprises:

looking up a value corresponding to the average voltage value at a preset brightness trend regulation curve, and obtaining the brightness trend regulation coefficient according to the value.

3. The brightness regulation method of a display panel according to claim 1, wherein the step of obtaining a brightness regulation coefficient according to the average voltage value comprises:

looking up a value corresponding to the average voltage value at a preset brightness regulation curve, and obtaining the brightness regulation coefficient according to the value.

* * * * *